US008336975B2

(12) United States Patent
Allard et al.

(10) Patent No.: US 8,336,975 B2
(45) Date of Patent: Dec. 25, 2012

(54) PLENUM ON FRONT OF REFRIGERATOR/FREEZER DOOR

(75) Inventors: Paul B. Allard, Stevensville, MI (US); James W. Kendall, Mount Prospect, IL (US); Steven J. Kuehl, Stevensville, MI (US); Alan S. Lucas, Evansville, IN (US); Andrew M. Tenbarge, Saint Joseph, MI (US); John J. Vonderhaar, Saint Joseph, MI (US); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 452 days.

(21) Appl. No.: 12/402,608

(22) Filed: Mar. 12, 2009

(65) Prior Publication Data

US 2009/0229297 A1 Sep. 17, 2009

Related U.S. Application Data

(60) Provisional application No. 61/035,775, filed on Mar. 12, 2008.

(51) Int. Cl.
*A47B 96/04* (2006.01)

(52) U.S. Cl. ..... 312/405.1; 312/405

(58) Field of Classification Search ..... 312/405, 312/405.1, 402, 404; 62/449, 389
See application file for complete search history.

(56) References Cited

U.S. PATENT DOCUMENTS

| | | | | | |
|---|---|---|---|---|---|
| 3,429,140 | A | * | 2/1969 | White | 62/389 |
| 3,476,295 | A | | 11/1969 | Telfer | |
| 4,090,641 | A | * | 5/1978 | Lindenschmidt | 222/504 |
| 4,779,939 | A | * | 10/1988 | Stich | 312/405 |
| 4,912,942 | A | | 4/1990 | Katterhenry et al. | |
| 5,048,233 | A | * | 9/1991 | Gidseg et al. | 49/501 |
| 5,263,509 | A | | 11/1993 | Cherry et al. | |
| 5,603,230 | A | * | 2/1997 | Tsai | 62/390 |
| 5,839,507 | A | | 11/1998 | Jensen | |
| 5,964,255 | A | | 10/1999 | Schmidt | |
| 5,996,370 | A | | 12/1999 | Lee | |
| 6,085,542 | A | | 7/2000 | Johnson et al. | |
| 6,138,432 | A | * | 10/2000 | Banicevic | 312/405 |

(Continued)

FOREIGN PATENT DOCUMENTS

DE 202007013031 U1 12/2007

(Continued)

OTHER PUBLICATIONS

European Patent Application No. 09720921-7, Applicant: Whirlpool Corporation, European Publication No. 22744562, Publication Date: Oct. 5, 2012.

*Primary Examiner* — Hanh V Tran
(74) *Attorney, Agent, or Firm* — Kirk W. Goodwin; Price Heneveld LLP

(57) ABSTRACT

A refrigerator includes a cabinet defining an open storage space. A door is disposed on the cabinet operable between an open position and a closed position. The door includes a forward wall and a rearward wall. An insulation layer is disposed between the forward wall and the rearward wall. An exterior skin is disposed adjacent to the forward wall and substantially covers the forward wall. A plenum is defined by the space between the exterior skin and the forward wall and is adapted to receive utility lines.

20 Claims, 10 Drawing Sheets

U.S. PATENT DOCUMENTS

| | | | | |
|---|---|---|---|---|
| 7,040,356 | B2 | 5/2006 | Tarlow | |
| 7,266,963 | B2 | 9/2007 | Lee | |
| 7,281,391 | B2 | 10/2007 | Marret et al. | |
| 7,331,163 | B2 | 2/2008 | Hau et al. | |
| 7,578,141 | B2 * | 8/2009 | Puthiyaveetil et al. | 62/389 |
| 7,866,773 | B2 * | 1/2011 | Leimkuehler et al. | 312/405 |
| 2004/0183414 | A1 | 9/2004 | Kwon | |
| 2006/0086130 | A1 | 4/2006 | Anselmino et al. | |
| 2006/0086136 | A1 | 4/2006 | Maritan et al. | |
| 2007/0119193 | A1 | 5/2007 | Davis et al. | |
| 2008/0143227 | A1 * | 6/2008 | Kim et al. | 312/405 |
| 2008/0223070 | A1 * | 9/2008 | Kim et al. | 312/405 |
| 2008/0258597 | A1 * | 10/2008 | Kwon et al. | 312/405.1 |

FOREIGN PATENT DOCUMENTS

| | | | |
|---|---|---|---|
| EP | 1830144 | A2 | 9/2007 |
| JP | 04068283 | A | 3/1992 |
| WO | 2007/062952 | A1 * | 6/2007 |

* cited by examiner

PLENUM ON FRONT OF REFRIGERATOR/FREEZER DOOR

CROSS-REFERENCE TO RELATED APPLICATION

This application claims priority under 35 U.S.C. §119(e) to U.S. Provisional Patent Application No. 61/035,775, entitled "REFRIGERATOR WITH SPACE MANAGEMENT MODULES," filed on Mar. 12, 2008, the entire disclosure of which is hereby incorporated herein by reference.

BACKGROUND OF THE PRESENT INVENTION

The present invention generally relates to a refrigerator and, more specifically, to a plenum disposed in a refrigerator door.

SUMMARY OF THE PRESENT INVENTION

In one aspect of the present invention, a refrigerator includes a cabinet defining an open storage space. A door is disposed on the cabinet operable between an open position and a closed position. The door includes a forward wall and a rearward wall. An insulation layer is disposed between the forward wall and the rearward wall. An exterior skin is disposed adjacent to the forward wall and substantially covers the forward wall. A plenum is defined by the space between the exterior skin and the forward wall and is adapted to receive utility lines.

In another aspect of the present invention, a method for making an appliance door includes providing a forward wall. An exterior skin is inserted over the forward wall spaced a predetermined distance from the forward wall. A plenum is formed defined by the space between the exterior skin and the forward wall. At least one utility line extends through the plenum. A removable module is installed in the appliance door. The at least one utility line is connected with the removable module disposed in the door. A rearward wall is installed spaced a predetermined distance from the forward wall. An insulation layer is inserted between the rearward wall and the forward wall. An end cap is provided adjacent the forward wall and includes a utility trough adapted to convey the at least one utility line from the end cap to the plenum.

In yet another aspect of the present invention, a door for an appliance includes a removable module disposed in the door and a forward wall. A rearward wall is spaced a predetermined distance from the forward wall. A liner is disposed a predetermined distance from the rearward wall. A plenum is defined by the space between the liner and the rearward wall. At least one utility line is channeled through the plenum and connected with the removable module disposed in the door.

These and other features, advantages and objects of the present invention will be further understood and appreciated by those skilled in the art upon studying the following specification, claims, and appended drawings.

DETAILED DESCRIPTION OF EMBODIMENTS

Figure 1A:
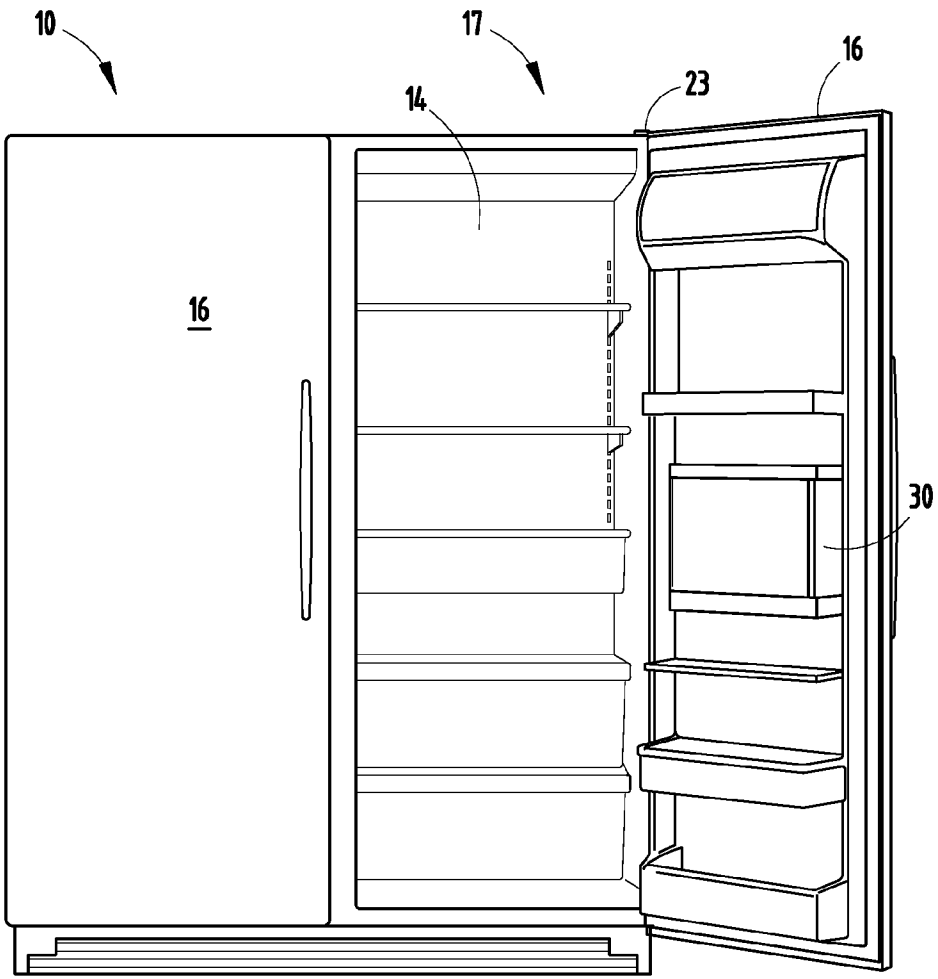
FIG. 1A is a front elevational view of the refrigerator of FIG. 1, with the door open.
Figure 1:
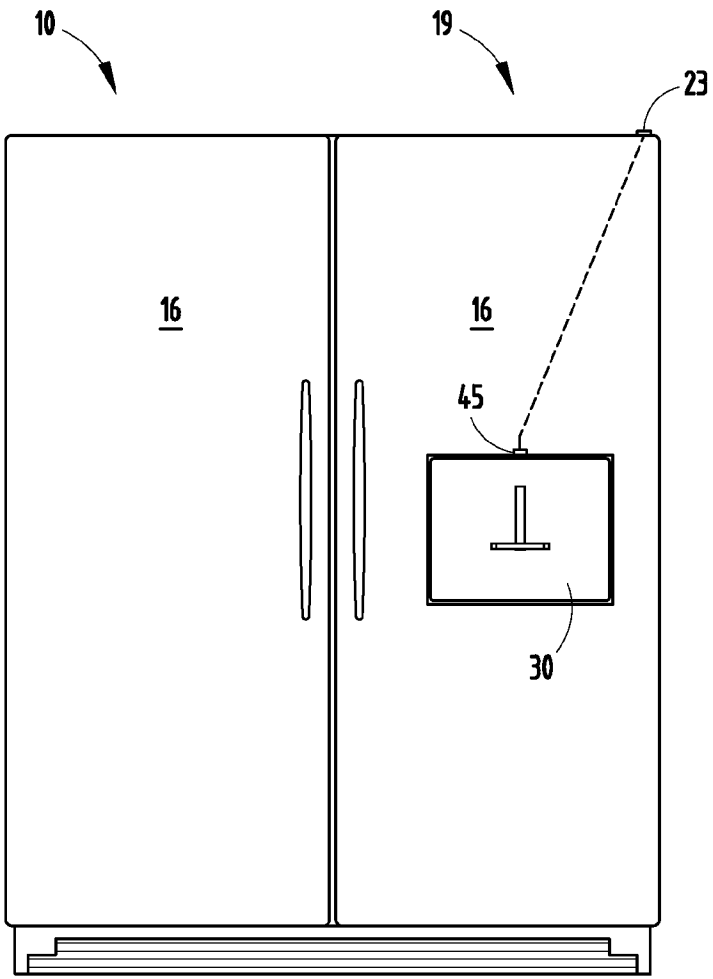
FIG. 1 is a front elevational view of one embodiment of a refrigerator incorporating the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 shown in FIGS. 1-4 generally designates a refrigerator having a cabinet 12 defining an open storage space 14. A door 16 is disposed on the cabinet 12 operable between an open position 17 and a closed position 19. The door 16 includes a forward wall 18 and a rearward wall 20. An insulation layer 22 is disposed between the forward wall 18 and the rearward wall 20. An exterior skin 24 is disposed adjacent to the forward wall 18 and substantially covers the forward wall 18. A plenum 26 is defined by the space between the exterior skin 24 and the forward wall 18 and is adapted to receive utility lines 28.

Figure 2A:
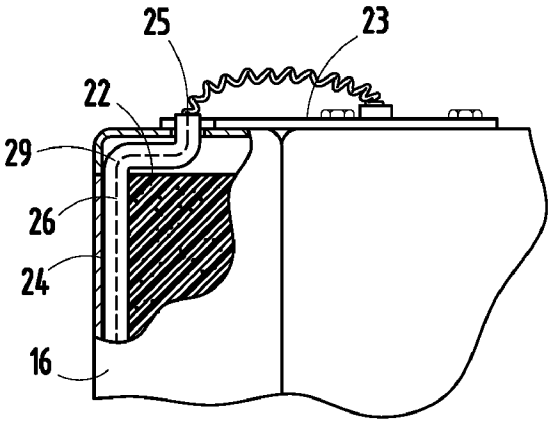
FIG. 2A is an enlarged side elevational partial view of the area IIA of FIG. 2.
Figure 2:
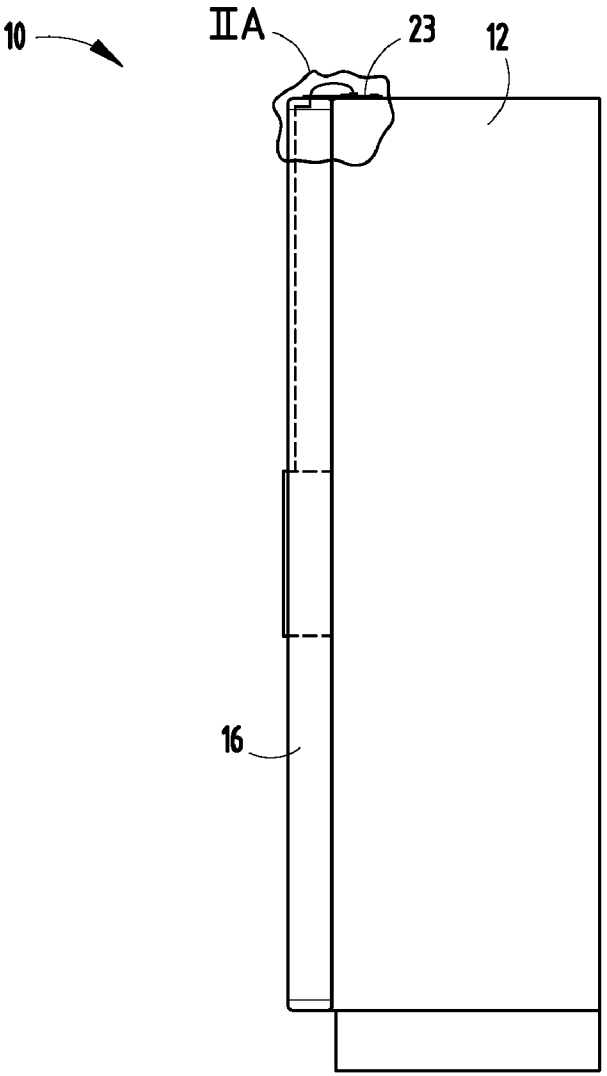
FIG. 2 is a side elevational view of the refrigerator of FIG. 1.

As shown in FIGS. 2 and 2A, a door hinge 23 is secured to a top corner of the door 16 and allows horizontal rotation of the door 16 between opened and closed positions 17, 19. A hinge channel 25 extends through the door hinge 23 and is in communication with the plenum 26. In the illustrated embodiment of FIGS. 3 and 4, the utility lines 28 extend through the hinge channel 25 of the door hinge 23 and into the plenum 26 or a channel 29 formed or constructed in the plenum 26. A swivel connector 35 may be attached to the channel 29 or plenum 26 that allows nonbinding transition of utility lines 28 from the door 16 to the refrigerator 10.

Figure 4:
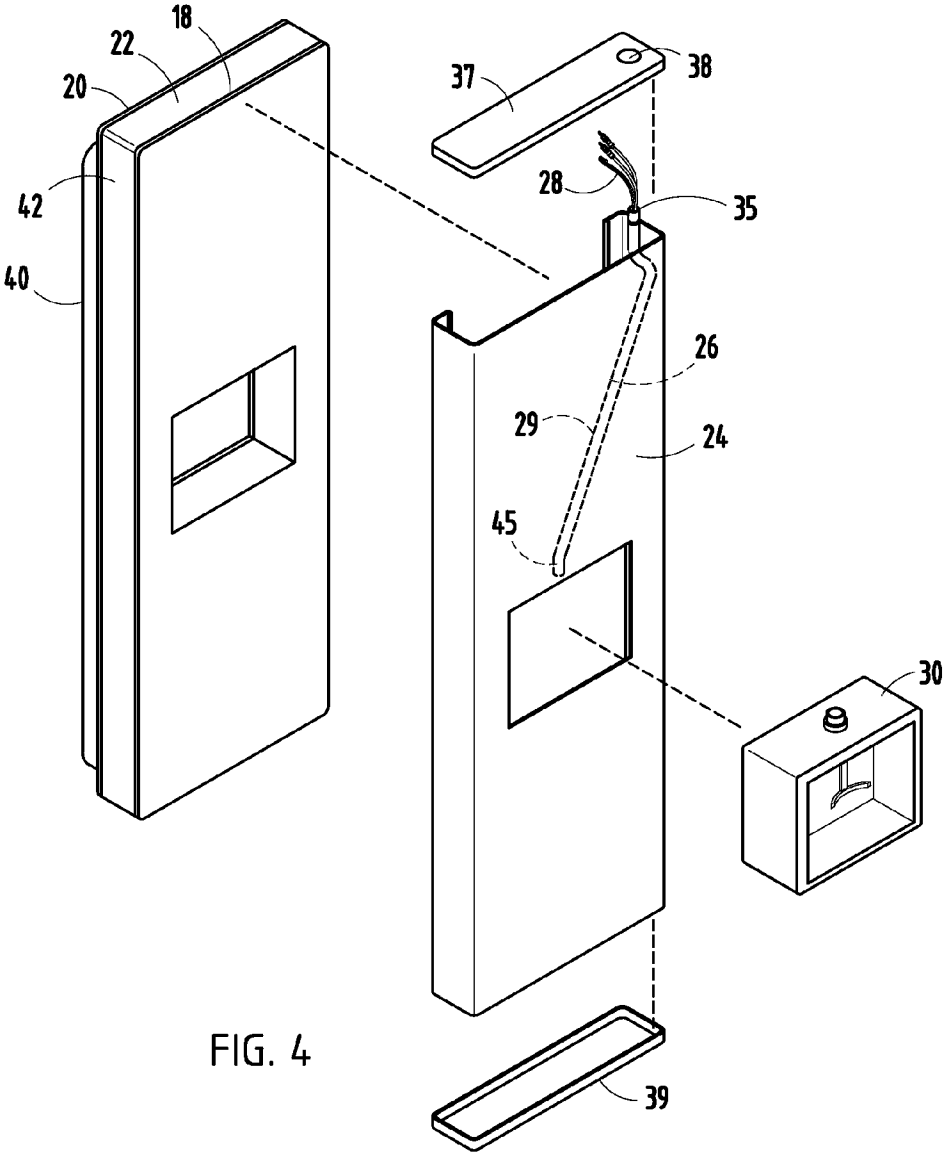
FIG. 4 is a top perspective exploded view of the door of FIG. 3.
Figure 3:
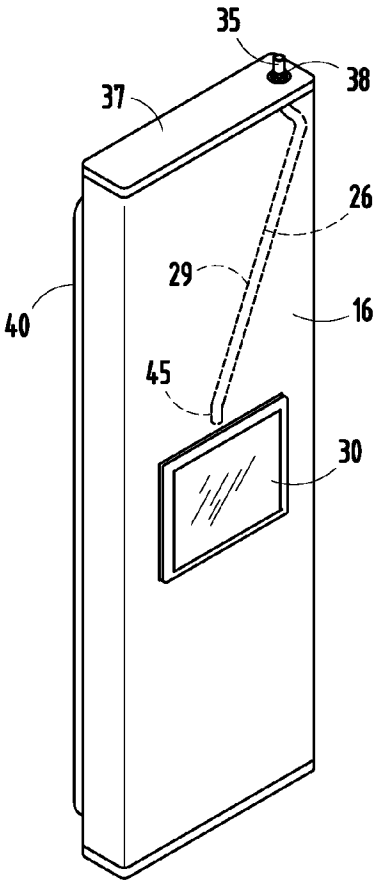
FIG. 3 is a top perspective view of a door incorporating another embodiment of the present invention.

Referring now to FIGS. 3 and 4, the illustrated refrigerator 10 includes a modular component 30 adapted for installation into one of the doors 16 of the refrigerator 10. The plenum 26 extends between the exterior skin 24 and the forward wall 18 of the door 16 and is designed to convey the utility lines 28, including any liquid conduits and electrical lines, from the refrigerator 10 to the modular component 30 in the refrigerator door 16. The plenum 26 extends up to an end cap 37 with an aperture 38 on the refrigerator door 16 where any utility lines 28 extending therethrough may be connected with the refrigerator 10 (FIG. 2A). The end cap 37 forms a utility trough therein that conveys utility lines 28 from the end cap 37 to the plenum 26. An end cap 39 extends over the bottom of the door 16. It is contemplated that a similar construction could be utilized, wherein the end cap 39 conveys utility lines 28 as well.

Referring again to FIGS. 3 and 4, the refrigerator door 16 of FIG. 1 is constructed with an interior liner 40 adjacent to the rearward wall 20. A foam insulated material 42 makes up the insulation layer 22 and is disposed between the rearward wall 20 and the forward wall 18. The plenum 26 extends between the forward wall 18 and the exterior skin 24 and is placed in the refrigerator door 16 during construction of the refrigerator door 16. Removable modules are designed to engage with the plenum 26 and receive utility lines 28 disposed in the plenum 26. As previously discussed, the plenum 26 is designed to convey electrical lines 34, as well as fluid conduits 32, into secure connection with the removable modular component 30, such that the removable modular component 30 can attach to a connection plug 45 and make use of electricity, as well as fluids flowing through the plenum 26. It will be understood by one having ordinary skill in the art that the modular component 30 could be any component adapted to interact with the refrigerator 10 and not just a water dispenser as illustrated in the accompanying figures.

Figure 5:
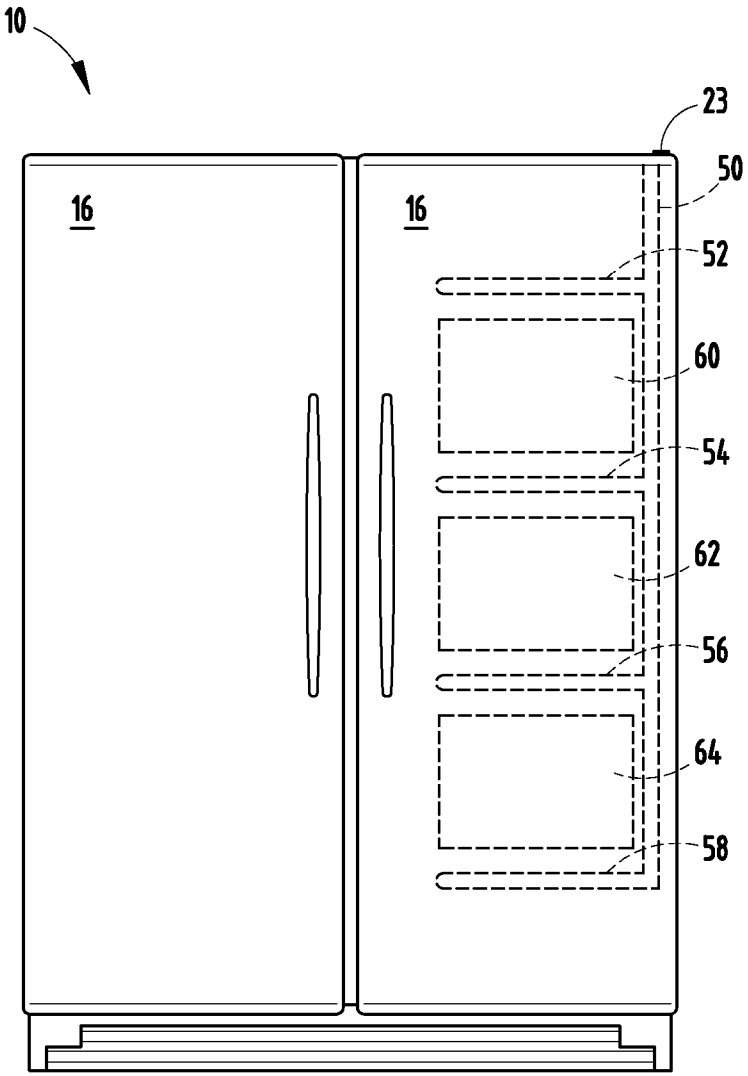
FIG. 5 is a front elevational view of another embodiment of a plenum of the present invention.
Figure 5A:
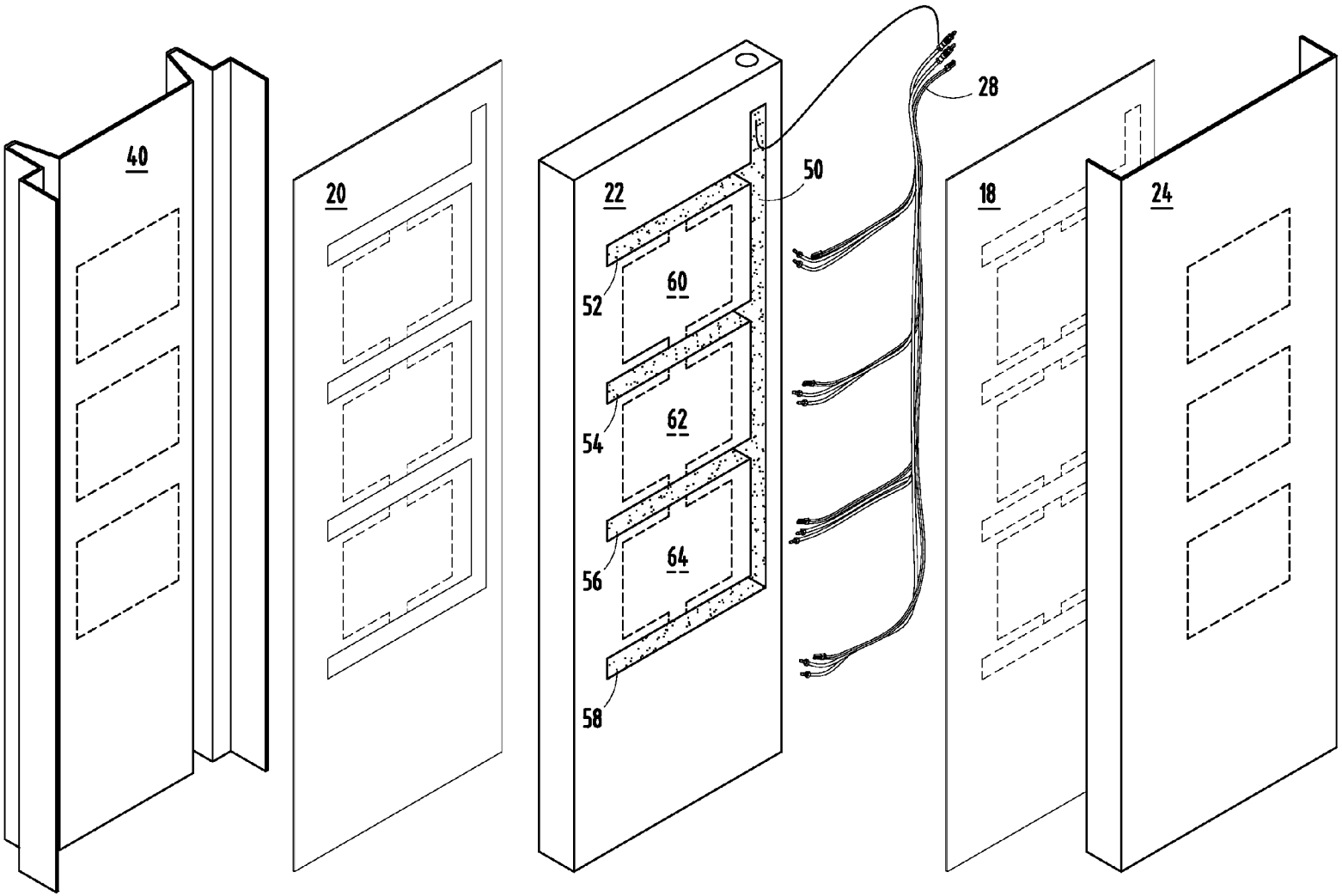
FIG. 5A is a top perspective exploded view of the refrigerator of FIG. 5.

Referring now to the illustrated embodiment of FIGS. 5 and 5A, the liner 40 is adjacent to the rearward wall 20. The insulation layer 22 extends between the rearward wall 20 and the forward wall 18. The exterior skin 24 extends over the forward wall 18 protecting the forward wall 18 from damage. The exterior skin 24 may be pre-formed in a variety of ways, including thermoformed, injection molded, folded, or reaction injection molded (RIM). In addition, the exterior skin 24 may include one or several materials, including fibrous material, wood, plastic, or metal. The insulation layer 22 includes a plenum 50 integrally formed in the insulation layer 22. The plenum 50 is designed to convey utility lines 28 to multiple positions 52, 54, 56, 58 adjacent to possible modular component locations or sites 60, 62, 64 in the door 16. Stated differently, the plenum 50 allows for connection of utility lines 28 to a modular component 30 that can be positioned in a variety of locations 60, 62, 64 in the door 16. It is contemplated that the plenum 50 could be made in a variety of ways. The plenum 50 may be molded during manufacturing, or the plenum 50 may be created afterwards by way of a foam compaction or cutting process.

Figure 6:
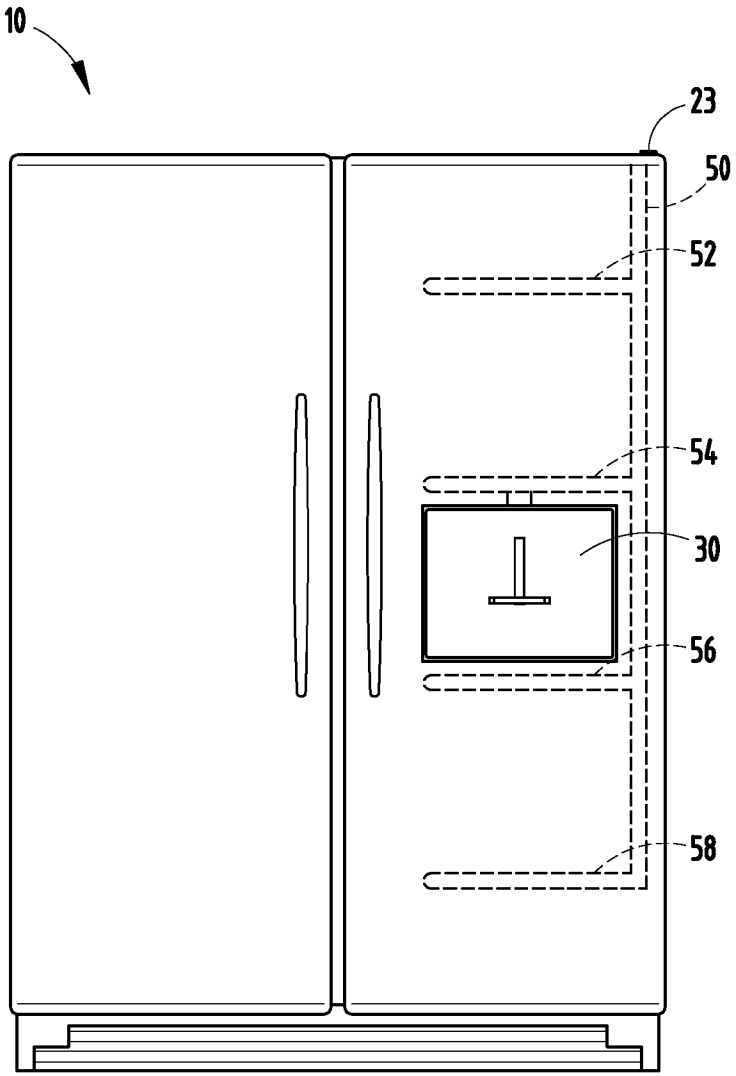
FIG. 6 is a front elevational view of the refrigerator of FIG. 5 with a removable module installed in the door.
Figure 6A:
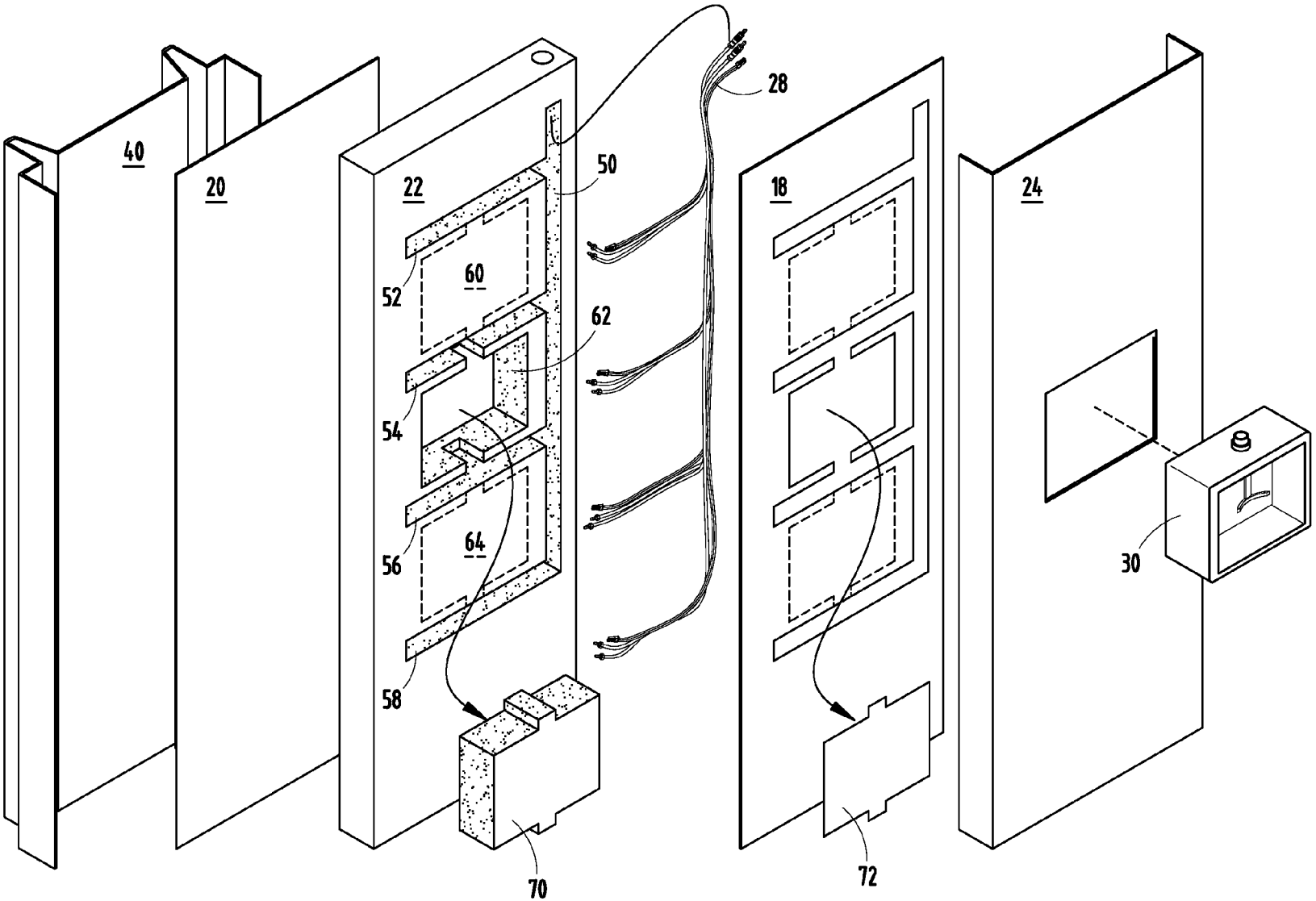
FIG. 6A is a top perspective exploded view of the refrigerator door of FIG. 6.

Referring now to FIGS. 6 and 6A, an insulation layer portion 70 and a forward wall portion 72 are removed from the insulation layer 22 and forward wall 18 to accommodate a removable modular component 30 that is inserted into the door 16. The plenum 50, which is defined by the space between the exterior skin 24 and the forward wall 18, is designed to receive utility lines 28 and connect with the modular component 30. It is contemplated that the plenum 50 will be generally constructed during the manufacturing of the door 16, although it could be molded before or fabricated after the door is assembled.

Figure 7A:
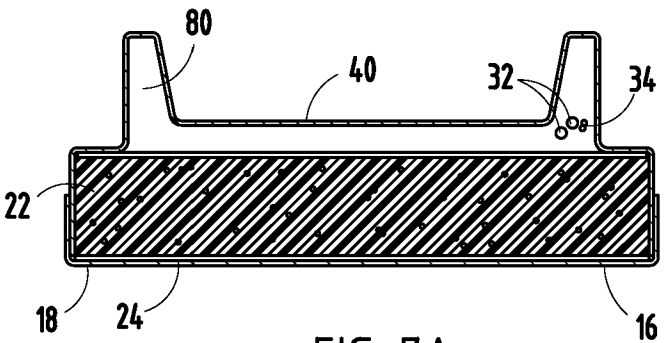
FIG. 7A is a top cross-sectional view of an interior plenum of FIG. 7 taken at line VIIA-VIIA.
Figure 7:
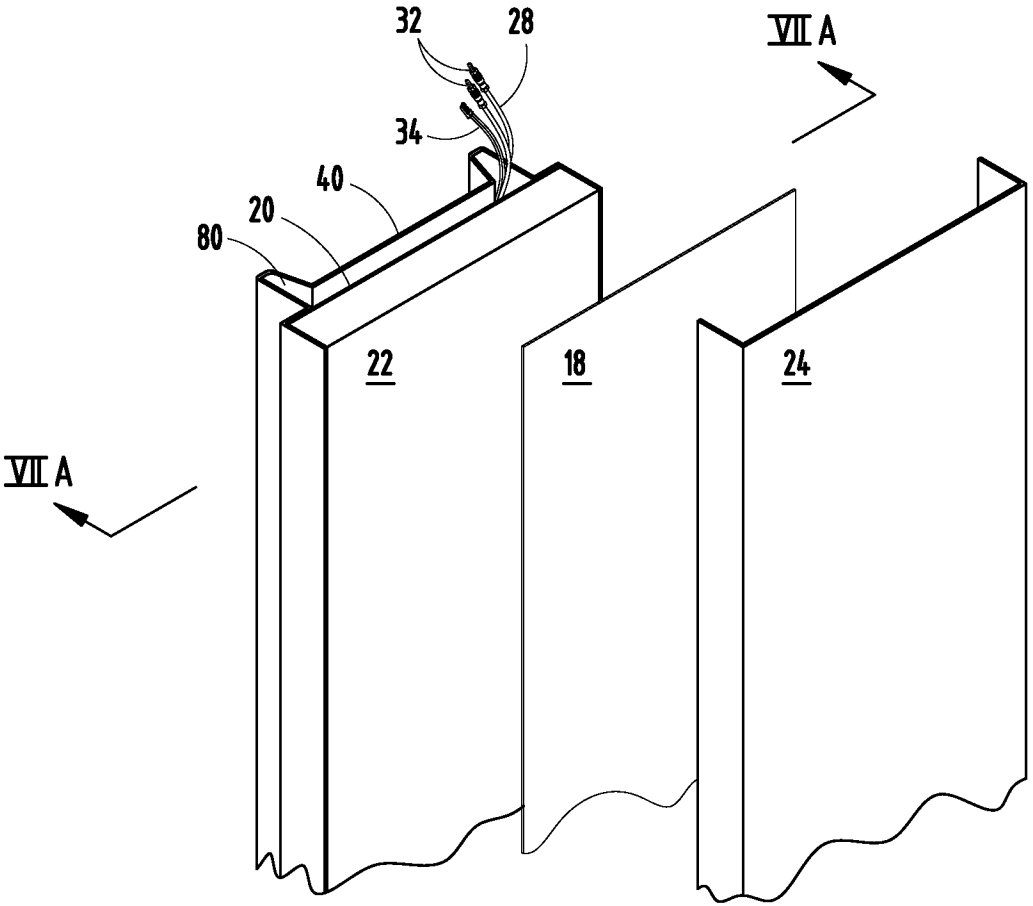
FIG. 7 is a top perspective enlarged partial view of another embodiment of the present invention.

Referring now to FIGS. 7 and 7A, in another embodiment of a plenum design, a plenum 80 is formed between the liner 40 and the rearward wall 20, such that utility lines 28 may be routed through the door 16 between the liner 40 and the rearward wall 20 into connection with a modular component 30 in the door 16. The plenum 80 may also extend between the liner 40 and the insulation layer 22 into connection with a modular component 30 in the door 16 if a rearward wall 20 is not present in the door 16 or if the rearward wall 20 is present, but cut out adjacent the modular component 30. Utility lines 28 extend through the door 16 to a storage compartment 100 in the door 16 or through the hinge 23 (FIG. 10) at one corner of the door 16 to route electricity or water therethrough. In this embodiment, exterior skin 24 is not necessary for creation of the plenum or completion of the door 16.

Figure 9:
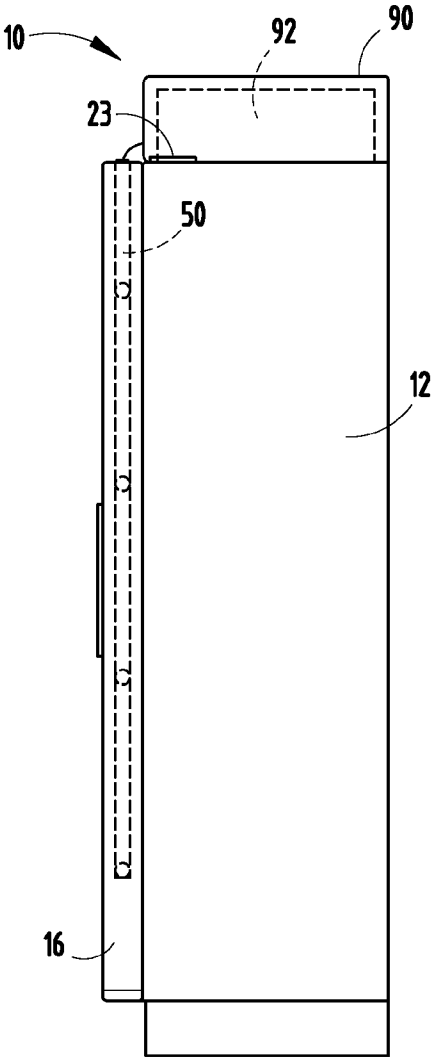
FIG. 9 is a side elevational view of the refrigerator of FIG. 8.
Figure 8:
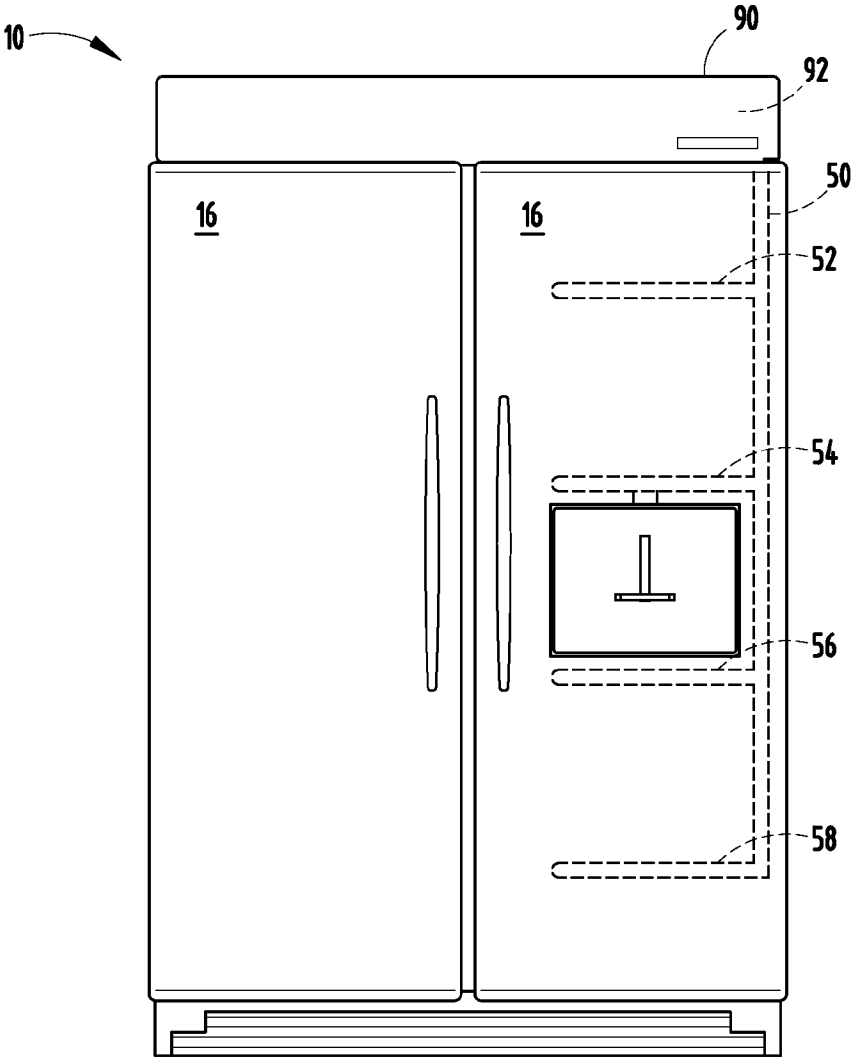
FIG. 8 is a front elevational view of yet another embodiment of a plenum of the present invention.

Referring now to FIGS. 8 and 9, in another embodiment of the present invention, a modular tank 90 including a storage compartment 92 is provided on a top wall of the refrigerator 10 and is adapted to hold fluid and route the fluid through the hinge 23 to the plenum 50 in the door 16 to a modular component 30. It is contemplated that the modular tank 90 disposed above the refrigerator 10 could store cool, warm, or hot water, modified atmosphere system devices, or various other items, as needed by the particular modular component 30 connected with the refrigerator.

Figure 11:
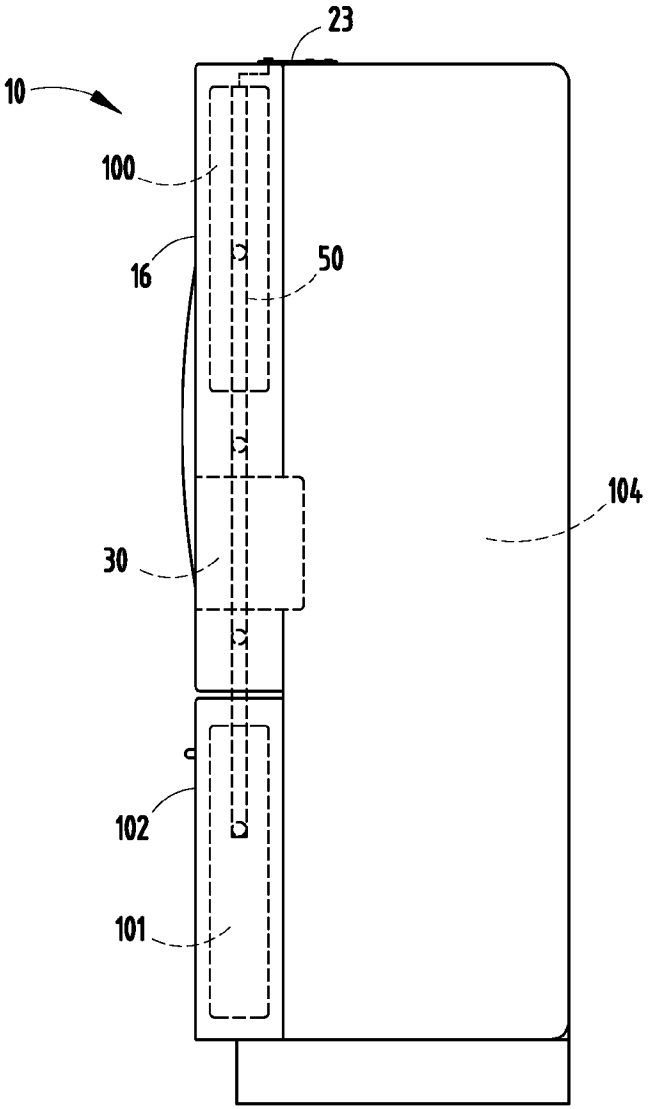
FIG. 11 is a side elevational view of the refrigerator of FIG. 10.
Figure 10:
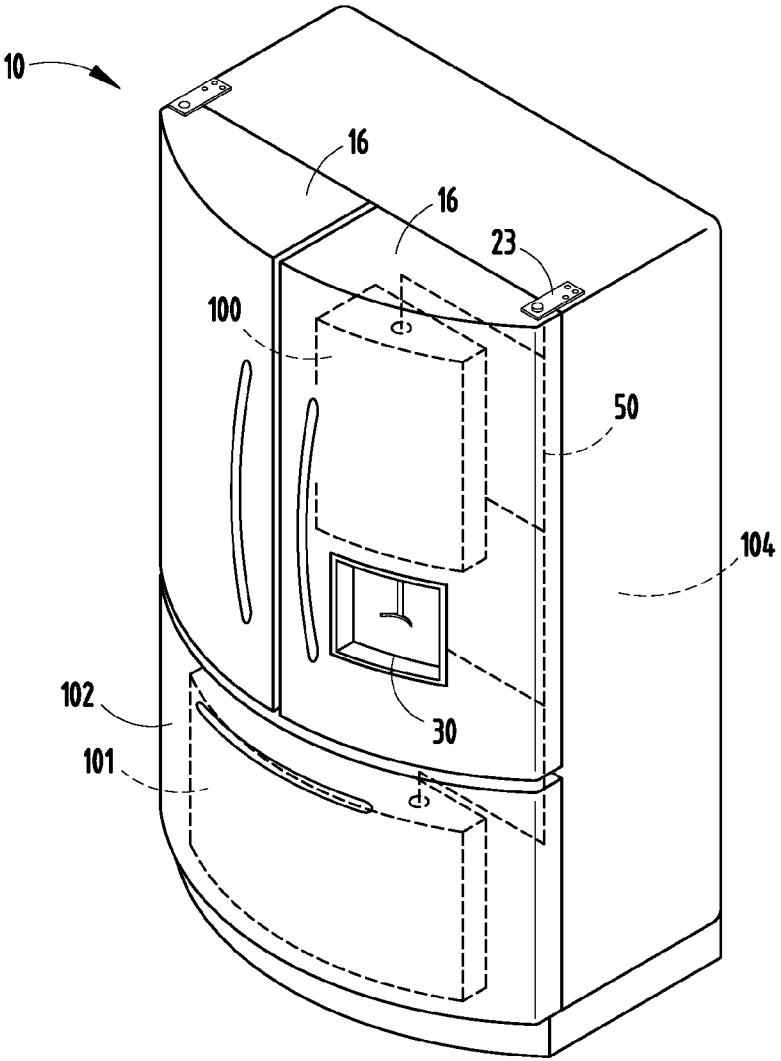
FIG. 10 is a top perspective view of yet another embodiment of the present invention incorporating storage compartments in the door assembly.

Referring now to FIGS. 10 and 11, storage compartments 100, 101 are formed in the door 16 of the refrigerator 10, as well as in a freezer compartment door 102 disposed below a refrigerator section 104 of the refrigerator 10. The storage compartments 100, 101 may be disposed between the insulation layer 22 and the exterior skin 24, between the forward wall 18 and the exterior skin 24, between the liner 40 and the rearward wall 20, or between the forward wall 18 and the rearward wall 20 in a cavity defined by a void in the insulation layer material 42. The same construction can be used in the storage compartment 101 in the freezer door 102. In the embodiments illustrated in FIGS. 10 and 11, the storage compartment 101 in the freezer door 102 holds a liquid, such as water, while the storage compartment 100 in the refrigerator door 16 holds ice. Both the water and ice are dispensed from the modular component 30 in the refrigerator door 16.

Figure 13:
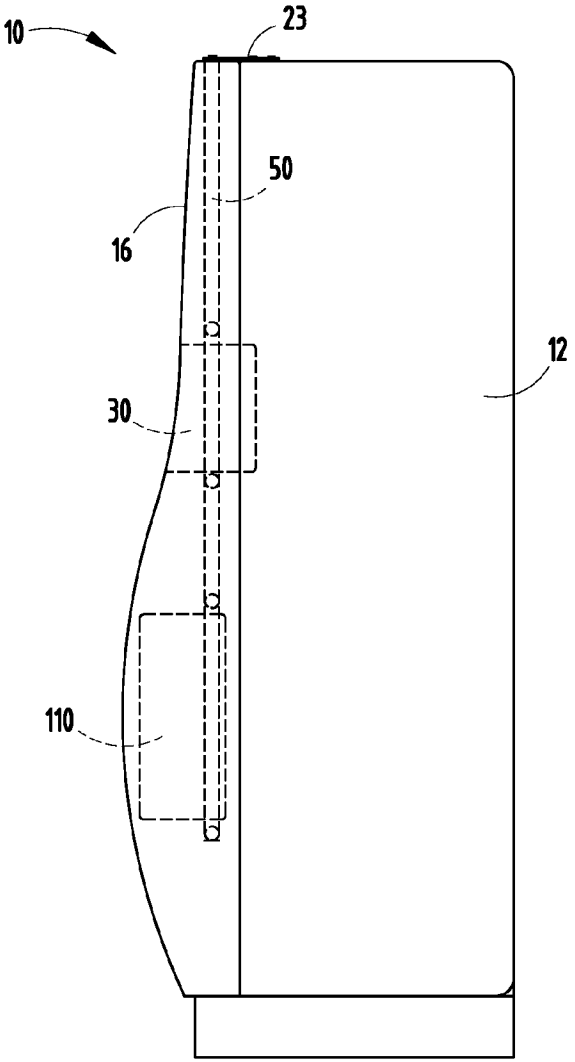
FIG. 13 is a side elevational view of the refrigerator assembly of FIG. 12.
Figure 12:
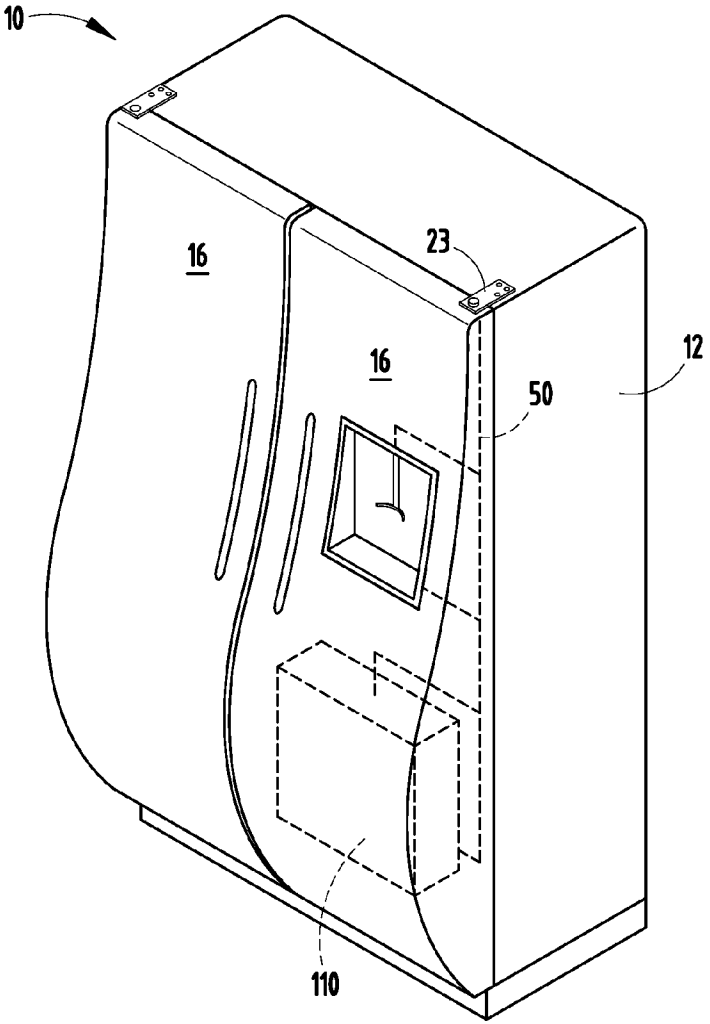
FIG. 12 is a top perspective view of yet another embodiment of the present invention incorporating a storage compartment in the door assembly.

Referring now to FIGS. 12 and 13, a storage compartment 110 is disposed in a lower portion of the refrigerator door below a modular component 30. The storage compartment 110 routes a fluid or gas from the storage compartment 110 to the modular component 30.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A refrigerator comprising:

a cabinet defining an open storage space;

a door disposed on the cabinet operable between an open position and a closed position, the door having a forward wall and a rearward wall and an insulation layer disposed between the forward wall and the rearward wall;

an exterior skin disposed adjacent to the forward wall and substantially covering the forward wall;

a plenum defined by the space between the exterior skin and the forward wall and adapted to receive a utility line;

a plurality of utility lines routed to a plurality of cutout locations within the forward wall and the insulation layer;

a module removably connected to the door and positioned in one of the plurality of cutout locations, wherein a portion of the module is disposed within the plenum; and a fluid source disposed on a top wall of the refrigerator, wherein one of the plurality of utility lines provides fluid communication between the fluid source and the removable module.

2. The refrigerator of claim 1, wherein the removable module is adapted for removable connection to one of the plurality of utility lines.

3. The refrigerator of claim 2, wherein one of the plurality of utility lines extends through the plenum and is removably connected with the module.

4. The refrigerator of claim 3, further comprising:

an aperture disposed on an end of the door and adapted to receive the plurality of utility lines into the plenum.

5. The refrigerator of claim 1, wherein the plenum includes utility passages that are integrally formed in the insulation layer.

6. The refrigerator of claim 1, further comprising:

a door hinge having a hinge channel in communication with the plenum, wherein the plurality of utility lines extend through the hinge channel to the plenum.

7. The refrigerator of claim 1, wherein the plurality of utility lines are adapted to convey at least one of electricity and fluid.

8. The refrigerator of claim 1, further comprising:

a fluid storage compartment disposed between the exterior skin and the rearward wall and in communication with the removable module.

9. The refrigerator of claim 1, wherein the fluid source is one of a fluid conduit and a fluid storage compartment.

10. A method for making an appliance door comprising:

providing a forward wall;

inserting an exterior skin over the forward wall spaced a predetermined distance from the forward wall;

forming a plenum defined by the space between the exterior skin and the forward wall;

extending a plurality of utility lines through the plenum;

forming a connection plug on an end of each of the plurality of utility lines;

installing a rearward wall spaced a predetermined distance from the forward wall;

inserting an insulation layer having a plurality of cutout locations between the rearward wall and the forward wall;

removing a portion of the insulation layer at one of the plurality of cutout locations to form a void;

installing a removable module in the void; and forming a fluid storage compartment above the appliance door, wherein one of the plurality of utility lines operably couples the fluid storage compartment with the removable module.

11. The method of claim 9, further comprising:

connecting one of the plurality of utility lines with the removable module.

12. The method of claim 10, further comprising:

providing an end cap adjacent the forward wall and having a utility trough therein adapted to convey one of the plurality of utility lines from the end cap to the plenum.

13. The method of claim 10, further comprising:

forming a second fluid storage compartment disposed in the appliance door between the forward wall and the rearward wall.

14. The method of claim 10, further comprising:

installing a door hinge on the appliance door having a channel in communication with the plenum and receiving the plurality of utility lines.

15. A door for an appliance comprising:

a forward wall including a plurality of cutouts;

a removable module;

a rearward wall spaced a predetermined distance from the forward wall;

a liner disposed a predetermined distance from the rearward wall; an insulation layer including a plurality of cutouts and disposed between the forward wall and the rearward wall;

a plenum defined by the space between the liner and the rearward wall; and a plurality of utility lines channeled through the plenum, wherein one of the plurality of utility lines is connected with the removable module, the removable module is positioned in one of the plurality of cutouts.

16. The door of claim 15, further comprising:

an end cap adjacent the forward wall and having a utility trough adapted to convey one of the plurality of utility lines from the end cap to the plenum.

17. The door of claim 16, further comprising:

a storage compartment disposed between the forward wall and the liner.

18. The door of claim 16, further comprising:

a utility trough disposed in the end cap.

19. The door of claim 15, further comprising:

a door hinge having a channel in communication with the plenum and receiving one of the plurality of utility lines.

20. The door of claim 15, further comprising:

an exterior skin constructed of a pre-formed material.

* * * * *